US005831208A

United States Patent [19]

Erickson

[11] Patent Number: 5,831,208

[45] Date of Patent: Nov. 3, 1998

[54] LEAD-FREE CENTERFIRE PRIMER WITH DDNP AND BARIUM NITRATE OXIDIZER

[75] Inventor: Jack A. Erickson, Andover, Minn.

[73] Assignee: Federal Cartridge Company, Anoka, Minn.

[21] Appl. No.: 768,773

[22] Filed: Dec. 13, 1996

[51] Int. Cl.[6] ..... C06B 31/28; C06B 45/06

[52] U.S. Cl. ..... 149/18; 149/68

[58] Field of Search ..... 149/68, 18

[56] References Cited

U.S. PATENT DOCUMENTS

| | | | |
|---|---|---|---|
| 2,009,556 | 7/1935 | McNutt | 149/35 |
| 2,027,825 | 1/1936 | Jacobs | 149/35 |
| 2,157,669 | 5/1939 | Lazier | 149/35 |
| 4,246,052 | 1/1981 | Hagel et al. | 149/105 |
| 4,363,679 | 12/1982 | Hagel et al. | 149/105 |
| 4,675,059 | 6/1987 | Mei | 149/43 |
| 5,216,199 | 6/1993 | Bjerke et al. | 149/68 |
| 5,417,160 | 5/1995 | Mei et al. | 149/68 |
| 5,547,528 | 8/1996 | Erickson et al. | 149/92 |

*Primary Examiner*—Edward A. Miller
*Attorney, Agent, or Firm*—Schroeder & Siefgried, P.A.

[57] ABSTRACT

A lead-free centerfire primer which, when fired, is devoid of serious toxic effects, and is characterized by the use of 5–20%, by weight, of barium nitrate as its oxidizer, in combination with 24–40% by weight of a primary explosive, 4–10% by weight of a sensitizer, 20–30% by weight of a nitrated ester, 4–10% by weight of an abrasive sensitizer, 4–7% by weight of a fuel, and 0.8–2.0% by weight of a binder.

10 Claims, No Drawings

LEAD-FREE CENTERFIRE PRIMER WITH DDNP AND BARIUM NITRATE OXIDIZER

BACKGROUND OF THE INVENTION

This invention is related to U.S. Pat. No. 5,547,528, entitled "NON-TOXIC PRIMER," and to copending application owned by the assignee hereof, and entitled "LEAD-FREE PRIMER MIX FOR CENTERFIRE CARTRIDGES", Ser. No.08/764,945, filed Dec. 13, 1996.

Most, if not all, manufacturers of primer mixes for centerfire cartridges utilize lead styphnate as a secondary explosive and barium nitrate as an oxidizer, despite the fact that the use of lead styphnate discharges toxic lead into the air, and the use of barium nitrate discharges toxic barium into the air, both in objectionable quantities. In current years, government agencies, such as the Federal Bureau of Investigation, have raised objections to the continued use of these materials in the manufacture of centerfire primers. Thus, the current upper level of barium, which is acceptable to be discharged into the air, when firing centerfire cartridges, is set at 3 mg per primer by the Federal Bureau of Investigation.

The levels of barium being discharged into the air, upon firing of centerfire rifle cartridges, is currently much higher than 3 mg/primer. Centerfire rifle cartridges currently discharge approximately 7.5 mg of barium into the air upon being fired. As can be readily seen, this amount greatly exceeds the desired limit of no more than 3 mg per round. Current lead styphnate primer mixes for centerfire cartridges use about 41% by weight of barium nitrate.

Within the last four (4) years, there has been a significant number of patents granted for lead-free and non-toxic primer mixes. These have generally used DDNP and tetracene as the explosives, smokeless propellant as a fuel, and various chemicals for oxidizers. The oxidizers frequently used have been $KNO_3$, $ZnO_2$, ZnO, $Sr(NO_3)_2$, $CaCo_3$, $ZrO_2$, Guanidine nitrate, $MnO_2$, CuO, etc. None of these oxidizers are ideal, because they are either hygroscopic, poor oxygen donors, or they are soluble in water.

Barium nitrate is recognized as a desirable supplier of oxygen, because it readily gives up its oxygen, is non-hygroscopic, and is not too soluble in water. To the best of our knowledge, however, no one has heretofore developed an environmentally acceptable lead-free centerfire primer mix, which has utilized barium nitrate as its oxidizer, probably because it is a heavy metal and has a well-recognized toxicity. We have discovered, however, that, if the proportions of the explosives, fuels, sensitizer, and binder are carefully selected, a highly effective and satisfactory centerfire primer can be prepared, while using quantities of barium nitrate sufficiently low to obviate toxicity objections, and yet ample to provide its desired oxidizing attributes. As a consequence, this new primer mix has a better supply of oxygen, is non-hygroscopic, and is at least equally insoluble in water.

BRIEF SUMMARY OF THE INVENTION

Our invention provides an improved lead-free primer mix, which uses barium nitrate as the primary oxygen supplier. The primer mix also utilizes a fine granulation of glass as a sensitivity controller and as a barrel erosion protector. It uses DDNP and tetracene as primary and secondary explosives, respectively. Smokeless propellant and aluminum are added to provide additional fuel.

We have found that, by selecting the proper proportions of the above components, we can produce a new lead-free primer mix which has excellent propellant igniting qualities, when compared to the regular lead styphnate-based primer mixes. This primer mix discharges into the air upon firing, only about 1.4 mg barium per small pistol cartridge, and about 2.5 mg barium per large rifle cartridge. Despite these marked reductions in toxicity, our tests show that we consistently obtained substantially better velocity and pressure results, as shown hereinafter in the specification.

Our preferred proportions of the ingredients of this new centerfire primer mix and the preferred ranges thereof are shown hereinbelow:

| | Preferred Proportion Ranges | Preferred Proportions |
|---|---|---|
| DDNP | 24–40% by weight | 32% by weight |
| Tetracene | 4–10% by weight | 8% by weight |
| Propellant Fines | 20–30% by weight | 27% by weight |
| Barium Nitrate | 5–20% by weight | 20% by weight |
| Ground Glass | 4–10% by weight | 8% by weight |
| Powdered Aluminum | 4–7% by weight | 4% by weight |
| Gum Tragacanth | 0.8–2.0% by weight | 1% by weight |

The sensitivity of the above centerfire primer mix has been tested many times and has been found to be satisfactory.

DETAILED DESCRIPTION OF THE INVENTION

The ranges of the various components of our new primer mix are set forth hereinabove in the Brief Summary of the Invention. Also included therein are the preferred proportions of each of the ingredients. We have made various tests to check and compare the energy output and shock velocities of primers made in accordance with these proportions, and have compared the same with lead styphnate-based primers containing barium nitrate and aluminum powder, which are the conventional components in most centerfire cartridge primers today. Set forth immediately hereinbelow are the results obtained in one of such tests, which is typical of the various testing results which we have obtained. It will be seen that, in each case, we utilized a control primer in comparison with our new lead-free primer mix:

| Primer | Output | Wave Velocity |
|---|---|---|
| Control large rifle primer (37 mg) | .89 | 1,663 ft/sec. |
| Sample lead-free large rifle primer (21 mg) | 1.11 | 1,668 ft/sec. |
| Control large rifle mag. primer (45 mg) | 1.19 | 1,733 ft/sec. |
| Sample lead-free large rifle mag. primer (25 mg) | 1.17 | 1,802 ft/sec. |

From the above, it can be seen that the output and wave velocity that is obtained from the samples of our new primer mix reflect favorably, as compared to the control primer, which was comprised of lead styphnate, barium nitrate, and aluminum powder. Thus, the 37 mg indicated in the first control sample for the large rifle primer indicates the size of the primer pellet as being 37 mg. This is in comparison to the sample of our new primer mix, in which we utilize only 21 mg of our new primer mix. It will be seen that, despite the fact that the size of the pellet of our new primer mix was less than 60% in weight of the primer pellet used in the control sample, the output figure exceeded the output figure of the control primer sample, and the wave velocity values exceeded those of the control primer. The wave velocity values constitute a measurement of the velocity of the shock wave produced by the primer upon firing.

The tests with the large rifle mag primer likewise shows favorable results from our new primer. It will be seen that the control primer mix, which was a lead styphnate-based primer, used a 45 mg pellet, whereas the comparable sample of our new primer mix was only 25 mg in weight. It will be seen that, despite the fact that the primer pellet weight of our new primer was less than 60% of that utilized in the control primer, the output was substantially the same, and the wave velocity exceeded that of the control sample.

The ballistic results which we obtained using our new primer formulation on pistol ammunition, using fast propellants, and when used in rifle cartridges using slow propellants, gave excellent results comparable to the above.

Further testing of our new primer mix under different temperature conditions also yielded favorable results, as shown immediately hereinbelow. In this case, 0.308 caliber Winchester rounds were primed with NT-215 primers (our new lead-free mix). Similar rounds were primed with control lead styphnate primers, in which barium nitrate was the oxidizer. These rounds were loaded with 168 grain hollow-point boattail bullets, and IMR 4064 (smokeless) propellant. These rounds were then conditioned at hot, cold and ambient temperatures, and fired for pressure and velocity values, as well as time-to-peak values. The results are shown immediately hereinbelow:

| Control | Velocity | Pressure | TTP |
|---|---|---|---|
| Ambient T | 2,646 ft/sec | 56,211 psi | 505 $\mu$/sec |
| Hot +125° T | 2,674 ft/sec | 56,968 psi | 529 $\mu$/sec |
| Cold −40° T | 2,589 ft/sec | 56,123 psi | 513 $\mu$/sec |
| **Sample NT** | **Velocity** | **Pressure** | **TTP** |
| Ambient T | 2,672 ft/sec | 62,344 psi | 450 $\mu$/sec |
| Hot +125° T | 2,670 ft/sec | 61,147 psi | 469 $\mu$/sec |
| Cold −40° T | 2,635 ft/sec | 63,955 psi | 427 $\mu$/sec |

The size of the primer pellet in each of the control rounds was 37 mg. The size of the sample NT of our new primer mix was 25 mg. It will be seen that the sample of our new primer mix exceeded the velocity of the control sample at both the ambient and −40° F. temperatures, and that velocities at 125° F. temperatures were approximately the same.

Further review of the above testing results shows that the peak pressures developed in the sample rounds containing our new primer mix substantially exceeded the pressure developed in the control samples, at each of the ambient, hot, and cold temperatures. It will also be seen that the time to peak of the samples containing our new primer mix was substantially less than those produced in the firing of the control samples. Thus, the results obtained in these tests show that our new primer mix performed better in each respect, except for the velocities produced at high temperatures, and at the latter, the results were approximately the same.

Set forth hereinbelow are some further test results of our new primer mix, in which the preferred proportions were utilized. The propellant which was utilized was one of the faster types of propellants. It will be seen that the tests were run at temperatures of 70° F., 125° F., and −40° F. The indication of back and front in the powder column indicates that the propellant in the back position is on the primer, and in the front position is on the bullet, so as to compare the results which are produced at different positions of the propellant, because of the orientation of the cartridge and gun. Under "Velocity," the lefthand column, indicates the average velocity, and the second column is an indication of the standard deviation. The third column indicates the range.

| Temp. °F. | Powder | Velocity (ft/sec) | | | Pressure (psi) | | | Avg | S.D. | Range |
|---|---|---|---|---|---|---|---|---|---|---|
| 70 | Back | 1,182 | 21 | 75 | 28,675 | 1,906 | 5,884 | 129 | 18 | 60 |
| 70 | Front | 1,194 | 9 | 28 | 29,937 | 888 | 2,905 | 115 | 6 | 22 |
| 125 | Back | 1,096 | 34 | 110 | 24,837 | 2,483 | 7,275 | 116 | 18 | 68 |
| 125 | Front | 1,107 | 25 | 77 | 25,616 | 1,603 | 4,932 | 122 | 9 | 28 |
| −40 | Back | 1,359 | 18 | 54 | 43,724 | 2,457 | 7,788 | 108 | 9 | 26 |
| −40 | Front | 1,346 | 36 | 125 | 41,778 | 4,108 | 14,526 | 111 | 22 | 64 |

The lefthand column, under the "Pressure" heading, is the average pressure, while the intermediate column indicates the standard deviation, and the third column reflects the range.

The column bearing the heading of "AVG" shows the average time to peak. The "S.D." column shows the standard deviation, and the "Range" column, in each instance, reflects the difference between the smallest and largest varieties in a distribution.

The above testing results merely shows that the new primer mix which we have developed produces good ballistics.

In order to determine the optimum range of the amount of barium nitrate to be utilized in our new primer mix, we ran tests on four (4) different samples, in which the barium nitrate content was varied at 5–10–15–20% by weight levels. The results of these tests are shown hereinbelow, with the proportions of the other ingredients also shown in percentages. It will be seen that the primary explosive is DDNP, and the sensitizer and secondary explosive is tetracene. The range of the barium nitrate tested was 5–20%. A nitrated ester, Hercules fines, was also utilized. An abrasive sensitizer, such as ground glass, was included to assist the barium nitrate in burning the fuel, aluminum. A binder, tragacanth, was included in the weight indicated. As shown, a 9 mm Luger cartridge was utilized, with a jacketed hollow-point bullet weighing 115 g. A Winchester propellant, WPR 287 was utilized as the propellant. The velocity which is indicated was the muzzle velocity, and the pressure was the peak pressure which was produced.

| | Sample 1 | Sample 2 | Sample 3 | Sample 4 |
|---|---|---|---|---|
| DDNP | 32% | 34% | 36% | 38% |
| Tetracene | 8% | 8.5% | 9% | 9.5% |
| Barium nitrate | 20% | 15.0% | 10% | 5% |
| Hercules fines | 27% | 28.7% | 30.4% | 32% |
| Glass | 8% | 8.5% | 9% | 9.5% |
| Aluminum | 4% | 4.25% | 4.5% | 4.75% |
| Gum Tragacanth | 10% | 1.06% | 1.12% | 1.18% |
| 9 BP load, 115 gr JHP, WPR 287: | | | | |
| Velocity | 1,101 ft/sec | 1,094 ft/sec | 1,091 ft/sec | 1,071 ft/sec |
| Pressure | 28,945 psi | 28,308 psi | 28,463 psi | 27,507 psi |
| Time to peak | 232 μ/sec | 231 μ/sec | 232 μ/sec | 239 μ/sec |

From the above test results, it can be seen that the samples having 10, 15, or 20% barium nitrate function very well, whereas the sample which utilized only 5% barium nitrate, although adequate, produced slightly less favorable results. The Samples 1, 2 and 3, which utilize barium nitrate portions of 10–20%, performed at similar levels, but somewhat above the performance of the 5% sample, Sample 4. Thus, the preferred range of barium nitrate is 10–20%, whereas the overall range is 5–20% by weight.

It will be seen from the above that the velocity of Samples 1–3, inclusive, range between 1,091–1,101 ft/sec, while Sample 4 produced a velocity of 1,071 ft/sec. Samples 1–3, inclusive, produced peak pressures of 28,308–28,945 psi, whereas Sample 4 produced peak pressures of 27,507 psi. The time to peak of Samples 1–3, inclusive, were 231–232, whereas the time to peak for Sample 4 was 239 milliseconds.

Since the values obtained with Sample 4 are less favorable than those developed in testing Samples 1–3, inclusive, it is clear that Sample 4 did not produce adequate ignition quite as well as the proportions utilized in Samples 1–3, inclusive.

From all of the above, it can be seen that we have developed a new primer mix which enables us to utilize the important attributes of barium nitrate, without producing serious toxic effects. Thus, we are able to take advantage of the fact that barium nitrate is non-hygroscopic, readily gives up its oxygen, and is not too soluble in water. These benefits are obtained, while avoiding emissions of barium at a serious toxic level. Thus, a substantial contribution to the art of producing lead-free centerfire primer mixes has been made.

It will, of course, be understood that various changes may be made in the form, details, arrangement and proportions of the parts without departing from the scope of the invention which comprises the matter shown and described herein and set forth in the appended claims.

I claim:

1. A lead-free centerfire cartridge primer which, when fired, is devoid of serious toxic effects, consisting essentially of:

(a) 24–40%, by weight, of diazodinitrophenol (DDNP);

(b) 4–10%, by weight, of a tetracene;

(c) 5–20%, by weight, of barium nitrate;

(d) 20–30%, by weight, of Hercules fines;

(e) 4–10%, by weight, of glass;

(f) 4–7%, by weight, of powdered aluminum, and (g) 0.8–2.0%, by weight, of a binder taken from the group of binder selected from the group consisting of tragacanth, gum Arabic, guar gum, and Karaya gum.

2. The lead-free centerfire cartridge primer defined in claim 1, wherein the amount of DDNP is about 32%, by weight.

3. The lead-free centerfire cartridge primer defined in claim 1, wherein the amount of tetracene is about 8%, by weight.

4. The lead-free centerfire cartridge primer defined in claim 1, wherein the amount of barium nitrate is about 10–20%, by weight.

5. The lead-free centerfire cartridge primer defined in claim 1, wherein the amount of barium nitrate is about 20%, by weight.

6. The lead-free centerfire cartridge primer defined in claim 1, wherein the amount of Hercules fines is about 27%, by weight.

7. The lead-free centerfire cartridge primer defined in claim 1, wherein the amount of ground glass is about 8%, by weight.

8. The lead-free centerfire cartridge primer defined in claim 1, wherein the amount of powdered aluminum is about 4%, by weight.

9. The lead-free centerfire cartridge primer defined in claim 1, wherein the binder is about 1%, by weight, of tragacanth.

10. A lead-free centerfire cartridge primer which, then fired, is devoid of serious toxic effects, consisting essentially of:

(a) about 32%, by weight, diazodinitrophenol (DDNP);

(b) about 8%, by weight, tetracene;

(c) about 27%, by weight, Hercules fines;

(d) about 20%, by weight barium nitrate;

(e) about 8%, by weight, ground glass;

(f) about 4%, by weight, of powdered aluminum; and (g) about 1%, by weight, of a binder selected from a group of binder selected from the group consisting of tragacanth, gum Arabic, guar gum, and Karaya gum.

* * * * *

UNITED STATES PATENT AND TRADEMARK OFFICE

CERTIFICATE OF CORRECTION

PATENT NO. : 5,831,208

DATED : November 3, 1998

INVENTOR(S) : Jack A. Erickson

It is certified that error appears in the above-identified patent and that said Letters Patent is hereby corrected as shown below:

Claim 10, line 1, after "which", correct "then" to read --when--.

Signed and Sealed this

Twenty-third Day of February, 1999

*Attest:*

Q. TODD DICKINSON

*Attesting Officer*

*Acting Commissioner of Patents and Trademarks*